US010164386B2

(12) United States Patent
Schläpfer

(10) Patent No.: US 10,164,386 B2
(45) Date of Patent: Dec. 25, 2018

(54) SOCKET OUTLET ADAPTER

(71) Applicant: Q2Power AG, Ruggell (CH)

(72) Inventor: Urs Schläpfer, Bülach (CH)

( * ) Notice: Subject to any disclaimer, the term of this patent is extended or adjusted under 35 U.S.C. 154(b) by 114 days.

(21) Appl. No.: 15/535,001

(22) PCT Filed: Nov. 26, 2015

(86) PCT No.: PCT/CH2015/000173

§ 371 (c)(1),
(2) Date: Sep. 25, 2017

(87) PCT Pub. No.: WO2016/090501

PCT Pub. Date: Jun. 16, 2016

(65) Prior Publication Data

US 2018/0048103 A1 Feb. 15, 2018

(30) Foreign Application Priority Data

Dec. 10, 2014 (CH) ..... 01906/14

(51) Int. Cl.
*H01R 24/76* (2011.01)
*H01R 27/02* (2006.01)
*H01R 13/453* (2006.01)

(52) U.S. Cl.
CPC ..... *H01R 24/76* (2013.01); *H01R 13/4534* (2013.01); *H01R 27/02* (2013.01)

(58) Field of Classification Search
CPC ..... H01R 13/4534; H01R 13/447
USPC ..... 439/137, 136
See application file for complete search history.

(56) References Cited

U.S. PATENT DOCUMENTS 5,919,060 A 7/1999 Lee
7,510,412 B1 * 3/2009 Valentin ..... H01R 13/4534 439/137
8,187,011 B1 * 5/2012 Baldwin ..... H01R 13/4534 439/137

(Continued)

FOREIGN PATENT DOCUMENTS

DE 914991 C 7/1954
DE 102006024996 A1 12/2007

OTHER PUBLICATIONS

International Search Report—English Translation, for Application No. PCT/CH2015/000173, dated Feb. 29, 2016.

(Continued)

*Primary Examiner* — Gary Paumen
(74) *Attorney, Agent, or Firm* — Paul C. Oestreich; Eminent IP, P.C.

(57) ABSTRACT

The invention relates to an electric socket outlet, in particular an electric socket outlet adapter (11) comprising a housing (13), a socket zone that is located on the housing (13) and includes a first socket (15) and a second socket (17) for accommodating plugs of a first standard and a second standard, the first and second sockets being provided with first and second plug holes. The socket outlet (11) also comprises a first movable protective element (19) which can cover the first plug holes as well as a second movable protective element (21) which can cover the second plug holes. In the closed position, the first or the second protective element (19, 21) is mechanically locked when the other protective element (19, 21) is in the open position.

17 Claims, 2 Drawing Sheets

(56) References Cited

U.S. PATENT DOCUMENTS

| | | | | |
|---|---|---|---|---|
| 8,187,012 | B1 * | 5/2012 | Baldwin | H01R 13/4534 439/137 |
| 2010/0041259 | A1 * | 2/2010 | Ni | H01R 13/4534 439/137 |
| 2012/0149221 | A1 * | 6/2012 | Huang | H01R 13/4534 439/137 |
| 2015/0099380 | A1 * | 4/2015 | Ruffner | H01R 13/4534 439/137 |

OTHER PUBLICATIONS

International Search Report and Written Opinion—German Language, Form PCT/ISA/210, for Application No. PCT/CH2015/000173.

* cited by examiner

SOCKET OUTLET ADAPTER

CROSS-REFERENCE TO RELATED APPLICATIONS

This US non-provisional patent application is a national stage entry from PCT Application No. PCT/CH2015/000173 filed on Nov. 26, 2015, titled: "SOCKET OUTLET ADAPTER", pending, which in turn claims benefit and priority to Swiss Patent Application No. 01906/14 filed on Dec. 10, 2014, titled: "SOCKET OUTLET ADAPTER", expired, the contents of both of which are incorporated by reference as if fully set forth herein and for all purposes.

BACKGROUND OF THE INVENTION

Field of the Invention

The invention relates to a socket outlet.

Description of Related Art

From the prior art, the most diverse socket outlet adapters are known, which are used primarily to bridge differences between different plug systems. For safety reasons, on the sockets of the socket outlet adapter, into which different plugs can be inserted, protection covers or sliders are arranged. These protection covers prevent the possibility of introducing plugs that do not fit or sharp objects into the sockets, which can lead to an accidental electric shock of a person. The protection covers or sliders can be opened exclusively with a plug provided for that purpose, whereas any attempt to open using plugs of incorrect type or other objects does not succeed. The protection covers or sliders are also referred to as child protection, since incorrect operation of the socket outlet adapter is performed primarily by children.

The disadvantage of such protection covers or sliders is that they often jam and can only be locked or unlocked together. This means that it is possible that other protection covers or sliders can be opened, as soon as a protection cover or a protection slider is opened by a corresponding plug.

In fact, the other sockets are usually covered by the inserted plug. Nevertheless, the protective function is not sufficient, particularly if small plugs are inserted into the socket outlet adapter, which cannot cover the other sockets.

In U.S. Pat. No. 5,919,060, such a socket outlet adapter with a first and a second protection slider is disclosed. The protection sliders are prestressed in a known manner by springs and they can be shifted linearly at a right angle with respect to the plug against the spring pressure by inserting electric plugs. The direction of the shifting is determined by front faces of the protection slider, which are in the shape of ramps. When a US plug is inserted, the first protection slider is shifted downward, so that the plug holes are opened. An insertion of an electric plug according to the South African standard into the socket outlet adapter shifts the second protection slider upward. The first and second protection sliders can be opened and closed independently of one another. The opening direction of the two protection sliders is in opposite direction. Thus, if the first protection slider is open, then the second protection slider can also be opened, since it is not prevented from doing so by the first protection slider or another mechanical locking.

SUMMARY OF THE INVENTION

The aim underlying the present invention results from the disadvantages of the described prior art and consists in developing a socket outlet adapter according the preamble, which reliably prevents incorrect operation and increases user safety.

According to the invention, the aim is achieved with a device according to the preamble of claim 1 in that, in the closed position, each of the first or second protective element is mechanically locked by means of an additional locking element, when the other protective element is in the open position. This mechanical locking ensures that at all times only one socket can be used with a fitting plug, while the other socket is reliably locked. A shifting or moving of the protective element of the free socket is therefore not possible, even if an attempt is made to insert a fitting plug.

In a particularly preferable embodiment, in the closed position, the first or second protective element is mechanically locked by the other protective element which is in open position and acts as the additional locking element. This feature makes it possible that the protective element, which is shifted anyway into the open position, is locked by this existing movement at the same time as the other protective element. The locking of the closed switch therefore occurs automatically, without the need for any other operating steps.

It was found to be advantageous if, in the closed positions, the first and second protective elements are prestressed in opposite movement directions. As a result, a plurality of protective elements can be arranged in the smallest space in the housing, protective elements which can interact with one another for the locking of the unused protective elements. Naturally, it would also be conceivable that the two protective elements are prestressed in a common movement direction.

The invention is preferably characterized in that the first protective element comprises a locking element, by means of which a mechanical contact with the second locking element is achieved, when the first or the second protective element is in the open position. The technical feature of a mechanical contact between the first and second protective elements enables a fool-proof locking possibility of the two protective elements.

Advantageously, on the locking element, a first and a second protrusion are formed one after the other in the movement direction of the first protective element, and the second protective element can be hooked onto said protrusions. As a result, two hook-in positions are formed, which are used for locking the first or the second protective element in the closed position. It is also conceivable to provide other protrusions in a plane parallel to the first and second protrusions, in order to be able to also lock other protective elements.

It has been found to be advantageous if the spacing of the first protrusion from the second protective element is smaller than the spacing of the second protrusion from the second protective element. As a result of this arrangement of the protrusions in steps, only one protrusion acts at any time, since the other protrusion is at a spacing that is too far for an interaction with the second protective element.

In an additional preferred embodiment, in the open position of the second protective element, the second protective element is hooked onto the first protrusion. Since the second protective element is always opened by a fitting plug, it is fixed in the open position by the plug. As a result, the first protective element, which is connected by positive locking to the second protective element, is also inevitably fixed and prevented from being shifted in the opening direction.

In an additional preferred embodiment, in the open position of the first protective element, the second protective element is hooked onto the second protrusion. By providing two protrusions, either the first or the second protective element can be locked in the closed position.

It has also been found to be advantageous if the locking element can be transferred from a first position, in which it is at a smaller spacing from the inner side of the housing, into a second position, in which it is at a greater spacing from the inner side of the housing. By means of this shifting of the locking element, it is possible, in an elegant manner, for either the first protrusion or the second protrusion to interact with the second protective element. Preferably, the protrusions interact with the spring holder of the second protective element. On the spring holder, an offset is formed in any case, which receives an additional function. It is also conceivable to use other protrusions or offsets of the second protective element for the hooking onto one of the protrusions of the locking element.

In a particularly preferable embodiment, on the inner side of the housing, a ramp is formed, along which the locking element can slide from the first position into the second position and vice versa. The ramp has exactly the height needed to shift the locking element into a position, in which the first protrusion or the second protrusion can interact with the second protective element.

The invention is preferably characterized in that the locking element has a slotted guide, by means of which the locking element is force guided along the ramp. The locking element is therefore always led on the ramp in the two shifting directions of the first protective element. Thereby, a jamming with the second protective element or other components within the housing is reliably prevented.

It has been found to be advantageous if the slotted guide is implemented by means of an elongated hole provided on the locking element and by means of a pin led through the elongated hole and connected to the housing. The elongated hole has the same orientation as the ramp. Since the pin is firmly connected to the housing, the locking element has to be held in each shifting position of the first protective element on the ramp. A loading of the locking element by means of the second protective element also does not lead to an evasive movement of the locking element.

In an additional preferred embodiment, the slotted guide is implemented by means of a guide rail which is oriented in ramp direction and connected to the housing. The locking element is then force guided on the housing in a free space between the ramp and the guide rail. Since the locking element does not have an elongated hole in this embodiment of the slotted guide, it is weakened less. However, the ramp and the guide rail have to be oriented precisely, so that the locking element can slide between them and does not jam.

Since, advantageously, the second protective element can be shifted from the closed position into the open position past the locking element, the shiftability of the second protective element is unimpeded. The locking element is led by the ramp into the shifting path of the second locking element only if the second protective element should be locked in any case.

Advantageously, a third protective element for the closing of a third socket is present, which third protective element interacts mechanically with the first or the second protective element. Indeed, it is conceivable that more than two sockets are provided on the plug outlet and that all the unused protective elements should be locked.

Additional advantages and features result from the following description of two embodiment examples of the invention in reference to the diagrammatic representations. In a representation that is not true to scale:

DETAILED DESCRIPTION

Figure 1:
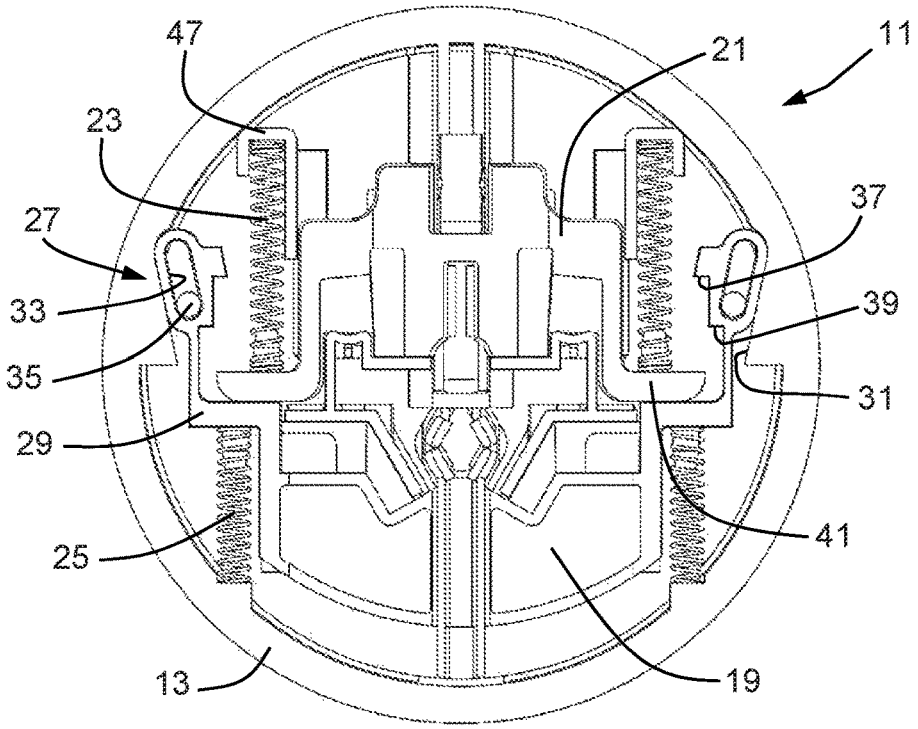
FIG. 1 shows: a cross-sectional representation of the electric plug outlet according to the invention with the first and second protective elements in closed position.
Figure 2:
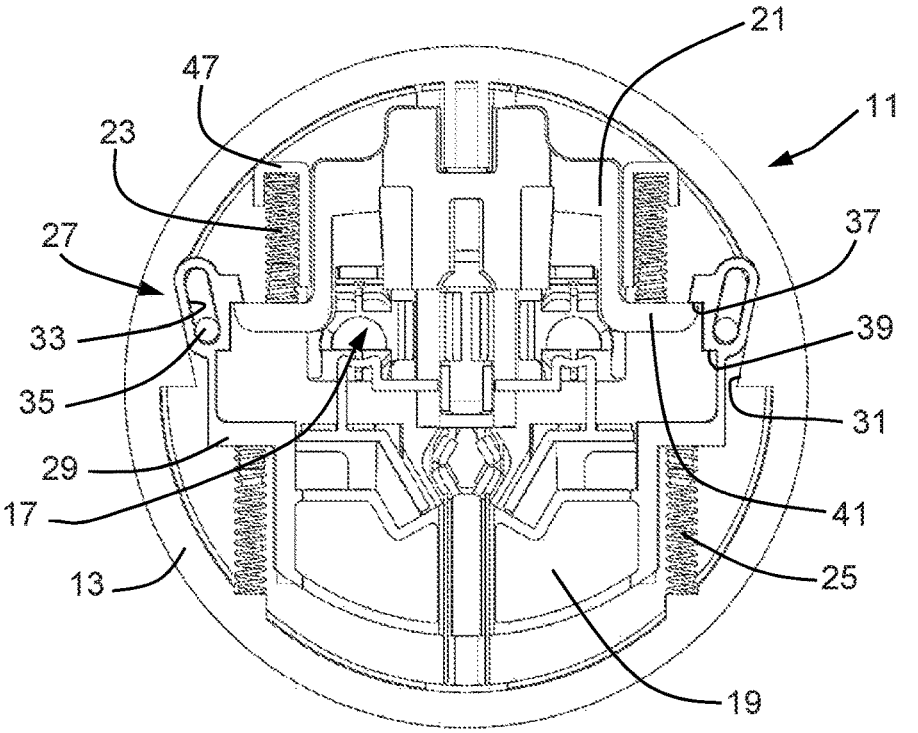
FIG. 2 shows: a cross-sectional representation in which the first protective element is in the closed position and the second protective element is in the open position.
Figure 3:
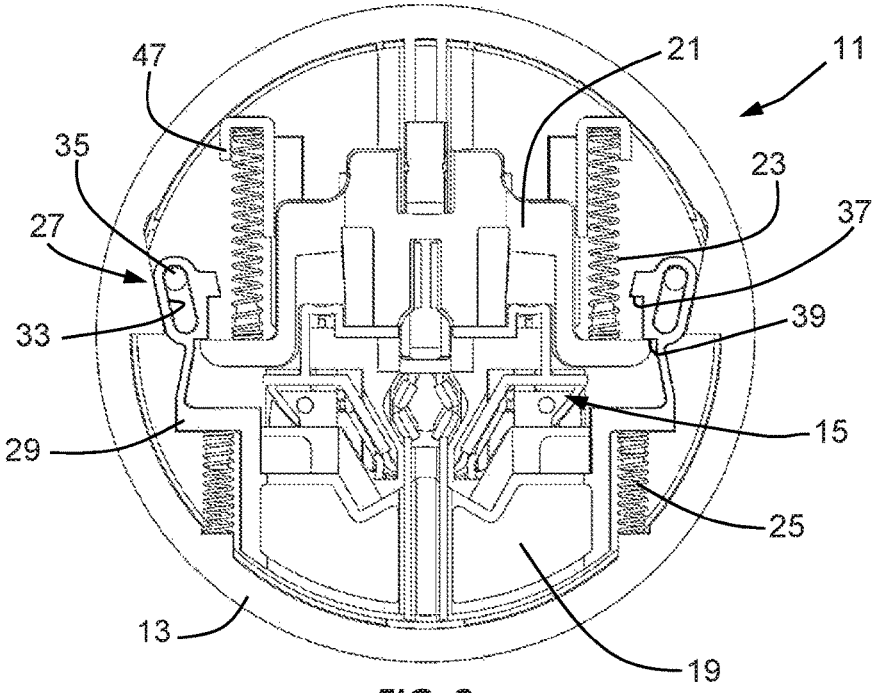
FIG. 3 shows: a cross-sectional representation in which the second protective element is in the closed position and the first protective element is in the open position.

In FIGS. 1 to 3, an embodiment example of the socket outlet according to the invention is shown in a cross-sectional representation, said plug outlet overall being marked with the reference numeral 11. The plug outlet 11 will preferably be a plug outlet adapter, so that the plugs of a certain standard can be used in countries with different plug standards. Such plug outlet adapters are also referred to as travel plugs or travel adapters. The plug outlet adapter 11 comprises a housing 13, in which the additional elements of the plug outlet adapter 11 are accommodated or arranged. On the upper side, the housing 13 comprises a socket area, which is not represented in further detail, with a first and a second socket 15, 17. It should be understood that the first and the second socket 15, 17 comprise plug holes (not shown in FIGS. 1 to 3). The first and second sockets 15, 17 are used for receiving plugs of a first and second standard. For example, the first socket 15 can be suitable for accommodating a US plug, and the second socket 17 can be suitable for inserting a UK plug.

In the housing 13, a first and a second protective element in the form of a first and a second slider 19, 21 are arranged. The sliders 19, 21 can be shifted linearly in a plane which is normal to the insertion direction of the plugs of a first and second standard. By inserting a plug, the sliders 19, 21 can be shifted from a closed position into an open position. In FIG. 1, the two sliders 19, 21 are shown in the closed position. In the closed position, the sliders 19, 21 are prestressed by first and second springs 23, 25. If a plug is pulled out of the first or second socket 15, 17, then the sliders 19, 21 are automatically closed, in that they are pushed back into the closed position by the springs 23, 25. As the figures show, the sliders 19, 21 are prestressed in opposite shifting directions. The springs 23, 25 thus compress the sliders 19, 21. The sliders 19, 21 can only be shifted by fitting plugs. This is preferably implemented by means of ramps provided on the sliders, which convert the insertion direction into a shifting direction perpendicular to the insertion direction. The insertion of plugs that do not fit or of pointed objects used for a purpose for which they are not intended is prevented by the sliders 19, 21.

If one of the two sockets 15, 17 is occupied, then the slider of the other socket is mechanically locked in the closed position. If the first slider 19 is open, then the second slider 21 is locked in the closed position thereof. If the second slider 21 is open, then the first slider 19 is locked in the closed position. This results in increased operational safety.

The first and second sliders 19, 21 can lock themselves with respect to one another, in that a mechanical connection between the two sliders 19, 21 is provided. This connection is implemented by means of a locking element 27 which is present in a pair in the embodiment example of FIGS. 1 to 3. The locking element 27 is fastened in the area of a spring holder 29 of the first slider 19. The locking element 27 is force guided along a ramp 31 which is formed on the housing inner side. The locking element 27 slides on the ramp 31 as on a rail and cannot deviate from the orientation of the ramp 31 due to the force guidance. Due to the ramp 31, the locking element 27 is pushed into the housing interior, when the first slider 19 is shifted from the closed position into the closed position.

The force guidance is implemented by means of a slotted guide. The slotted guide comprises an elongated hole 33 provided on the locking element 27, and a pin 35 connected to the housing 13. The elongated hole 33 has the same orientation as the ramp 31 and is therefore oriented parallel to the ramp 31. The pin 35 is stationary attached to the housing inner side. As a result, when the locking element 27 is pulled down by the first slider 19, it cannot deviate from the ramp 31.

On the locking element 27, a first protrusion 37 and a second protrusion 39 are formed, onto which the spring holder 41 of the second slider 21 or another offset of the second slider 21 can be hooked. The first and second protrusions 37, 39 are arranged above one another. In other words, the first and second protrusions 37, 39 are arranged one after the other in movement direction of the sliders 19, 21.

When the second slider 21 is shifted into the open position, the spring holder 41 can slide past the second protrusion 39, since the latter is arranged at a greater spacing from the spring holder 41, and since the locking element 27 is not pressed into the housing interior by the ramp 31 in the closed position of the first slider 19. When the second slider 21 reaches the open position, the spring holder 41 abuts against the first protrusion 37. The second slider 21 is fixed in the open position by an inserted plug. The first slider 19 is held in the closed position by means of the first protrusion 37 and locked. This locking or blocking of the first slider 19 is shown in FIG. 2.

In FIG. 3, the locking or blocking of the second slider 21 is shown in the first position. By inserting a fitting plug, the first slider is shifted downward into the open position. In the process, the locking element 27 is led along the ramp 31 and shifted by the ramp 31 by the height of the ramp 31 into the housing interior. In the open position of the first slider 19, the spring holder 41 hooks onto the second protrusion 39. The second slider 21 is therefore locked in the closed position by the locking element 27, when the first slider 19 is in the open position.

Figure 4:
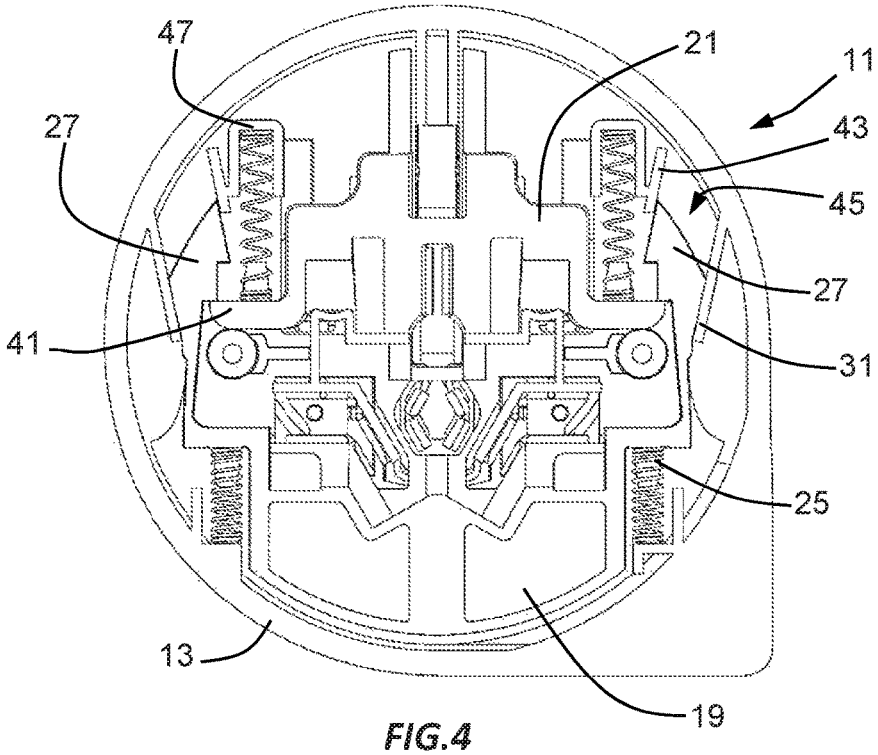
FIG. 4 shows: a cross-sectional representation in which the second protective element is in the closed position and the first protective element is in the open position with an alternative slotted guide.

In FIG. 4, the locking or blocking of the second slider 21 in the closed position is also shown. However, the slotted guide is implemented differently from the embodiment example of FIGS. 1 to 3. The pin 35 and the elongated hole 33 are replaced by a guide rail 43 in this embodiment example. As a result, between the ramp 31 and the guide rail 43, a free space 45 is formed, in which the locking element 27 can slide and is force guided. The locking element 27 is dimensioned in such a manner that it fits precisely into the free space 45, without jamming or tilting therein.

The guide rail 43 can be fastened to any site of the housing 13, as long as it is oriented precisely in the direction of the ramp 31. In FIG. 4, it is shown that the guide rail 43 is formed on the housing spring holder 47 of the first spring 23. As a result, no additional fastening to the housing 13 is needed, since the housing spring holder 47 has to be attached in any case to the housing 13, so that the first spring 23 can press on the housing 13.

The plug outlet 11 according to the invention enables the space saving, simple and reliable blocking of the free socket, when the other socket is occupied by a plug.

LIST OF REFERENCE NUMERALS

11 Electrical plug outlet adapter
13 Housing
15 First socket
17 Second socket
19 First protective element, first slider
21 Second protective element, second slider
23 First springs
25 Second springs
27 Locking element
29 Spring holder of the first slider
31 Ramp
33 Elongated hole
35 Pin
37 First protrusion
39 Second protrusion
41 Spring holder of the second slider
43 Guide rail on the housing
45 Free space
47 Housing spring holder

The invention claimed is:

1. An electric socket outlet adapter, comprising:

a housing;

a socket zone that is located on the housing, the socket zone further comprising:

a first socket and a second socket for accommodating plugs of a first standard and a second standard, respectively, the first socket and the second socket being provided with first and second plug holes, respectively;

a first movable protective element which can be adjusted between a first closed position and a first open position, which covers the first plug holes in the first closed position and unblocks the first plug holes in the first open position;

a second movable protective element which can be adjusted between a second closed position and a second open position, which covers the second plug holes in the second closed position and unblocks the second plug holes in the second open position; and wherein the first and the second protective elements are prestressed in order to be able to return automatically into the first and the second closed positions, respectively; and a locking element coupled to the first protective element, the locking element further comprising a first protrusion and a second protrusion configured to mechanically engage the second protective element.

2. The electric socket outlet adapter according to claim 1, wherein during the first closed and the second open positions, the first protective element is mechanically locked closed by the first protrusion of the locking element.

3. The electric socket outlet adapter according to claim 2, wherein the first protrusion engages a spring holder of the second protective element.

4. The electric socket outlet adapter according to claim 1, wherein during the second closed and first open positions, the second protective element is mechanically locked closed by the second protrusion of the locking element.

5. The electric socket outlet adapter according to claim 4, wherein the second protrusion engages a spring holder of the second protective element.

6. The electric socket outlet adapter according to claim 1, wherein during the first and second closed positions, the first and second protective elements are prestressed in opposite movement directions.

7. The electric socket outlet adapter according to claim 1, wherein the locking element further comprises a mechanical contact with the first protrusion during the first closed and the second open positions.

8. The electric socket outlet adapter according to claim 1, wherein the locking element, further comprises a mechanical contact with the second protrusion during the first open and second closed positions.

9. The electric socket outlet adapter according to claim 1, wherein during the second open position, the second protective element is hooked onto the first protrusion.

10. The electric socket outlet adapter according to claim 1, wherein during the first open position, the second protective element is hooked onto the second protrusion.

11. The electric socket outlet adapter according to claim 1, wherein the locking element is mechanically attached to the first protective element at a spring holder.

12. The electric socket outlet adapter according to claim 1, wherein a ramp is disposed on an inner side of the housing, along which the locking element can slide between: (1) a first closed and a second open position, and (2) a first open and a second closed position, and (3) a first closed and a second closed position.

13. The electric socket outlet adapter according to claim 12, wherein the locking element further comprises a slotted guide configured to be force guided along the ramp.

14. The electric socket outlet adapter according to claim 13, wherein the slotted guide further comprises:

an elongated hole provided on the locking element; and a pin passing through the elongated hole and connected to the housing.

15. The electric socket outlet adapter according to claim 1, wherein the locking mechanism further comprises a guide rail which is oriented in ramp direction and connected to the housing.

16. The electric socket outlet adapter according to claim 1, wherein the second protective element can be shifted from the second closed position into the second open position along the locking element.

17. The electric socket outlet adapter according to claim 1, wherein the second protective element can be shifted from the second open position into the second closed position along the locking element.

* * * * *